US005964112A

United States Patent [19]

Stefanescu

[11] Patent Number: 5,964,112

[45] Date of Patent: Oct. 12, 1999

[54] LOCKING CYLINDER AND LOCKING APPARATUS

[75] Inventor: Alexander Stefanescu, Velbert, Germany

[73] Assignee: C. Ed. Schulte GmbH, Velbert, Germany

[21] Appl. No.: 08/992,606

[22] Filed: Dec. 17, 1997

[30] Foreign Application Priority Data

Dec. 23, 1996 [DE] Germany ..... 196 54 136
May 9, 1997 [DE] Germany ..... 297 08 308 U

[51] Int. Cl.[6] ..... E05B 27/00

[52] U.S. Cl. ..... 70/493; 70/358; 70/406

[58] Field of Search ..... 70/409, 405, 406, 70/407, 358, 493, 494, 495

[56] References Cited

U.S. PATENT DOCUMENTS

| | | | |
|---|---|---|---|
| 1,257,987 | 3/1918 | Epstein | 70/493 |
| 4,098,104 | 7/1978 | Wolter | 70/406 |
| 4,116,025 | 9/1978 | Wolter | 70/358 |
| 4,377,082 | 3/1983 | Wolter | 70/364 A |
| 4,393,673 | 7/1983 | Widen | 70/358 |
| 4,434,636 | 3/1984 | Prunbauer | 70/358 |
| 4,638,651 | 1/1987 | Surko, Jr. | 70/364 A |
| 4,712,399 | 12/1987 | Mattossovich | 70/364 A |
| 4,905,489 | 3/1990 | Keller | 70/378 |
| 5,457,974 | 10/1995 | Keller | 70/358 |
| 5,475,998 | 12/1995 | Raskevicius et al. | 70/495 |

FOREIGN PATENT DOCUMENTS 112761 1/1918 United Kingdom .

*Primary Examiner*—Steven Meyers
*Assistant Examiner*—Clifford B Vaterlaus
*Attorney, Agent, or Firm*—Martin A. Farber

[57] ABSTRACT

A locking cylinder (1) with a cylindrical housing (2) of which the core bore (7) receives a cylindrical core (8) having a key channel (9) with core pins provided in the cylindrical core and housing pins displaceably guided in housing pin bores, the housing pins being resiliently biased by springs in the direction of the core pins, and with at least one additional, core-adjacent tumbler element (15) adjacent the wide-side profile of the key, the element (15) being displaceable in a cavity (H) crossing the rotational interface of the cylindrical core, the tumbler element being spring biased in the outward direction of the core and having a control projection (22, 51) projecting sidewards into the key channel (9, 43). In order to provide greater security, a locking recess (13', 48) is located in crossing or opposing relation to the housing pin bores, for receiving the additional tumbler element (15, 49) so as to block rotation, in which a housing-adjacent tumbler pin (14) biased in the inward direction of the core is able to project into the core cavity (13) when the tumbler pin (15) is withdrawn across the rotational interface (F), and in which the spring force of the spring (17) loading the additional tumbler element (15) is larger than that of the spring (18) which loads the housing-adjacent tumbler element (14).

24 Claims, 13 Drawing Sheets

2
1
4
5
8
31
33
T
28
26
25
28
27
30
28
27
11
12'
12

45
44
48
54
49
43
55
7
47
36
50
H'
8'
58
51
F
41
46
42
40
38
35
39
37

LOCKING CYLINDER AND LOCKING APPARATUS

FIELD AND BACKGROUND OF THE INVENTION

The invention relates to a locking cylinder with a cylindrical housing, of which the core bore receives a cylindrical core having a key channel, with core pins located in the cylindrical core, and displaceably guided housing pins in housing pin bores, the housing pins being biased by springs in the direction of the core pins, and with at least one core-adjacent additional tumbler element moveable, in a cavity which intersects the rotational interface of the cylindrical core by a wide-side profile of the key, the tumbler element being spring-loaded in the outward direction of the core, and having a control projection extending sidewards into the key channel.

A locking cylinder of the kind discussed herein is known from GB 112 761, in which the additional tumbler element has a tubular section, on the outside of which, extending along the tubular part, a hook-like portion is applied. The longer hook portion extends parallel with the key channel and there supports a spring in the form of a compression spring, which spring-loads the additional tumbler element in the outward direction of the core so that it reaches an abutment position. The shorter hook portion, running approximately at right angles to the longer hook portion, provides the guiding projection which extends into the key channel. With its tube-like section the tumbler element surrounds a tumbler consisting of a core pin and a housing pin such that, when the key is withdrawn, the tube-like section of the tumbler element intersects the rotational interface of the cylindrical core. The arrangement of the tumblers takes place by way of lock notches cut into the edge of the key whereas the mounting of the tumbler element takes place by way of a longitudinal groove in the wide side of the key. In addition to having a shape which is costly to manufacture, there is the disadvantage that if the additional tumbler element should be displaced in the release direction past the rotational interface of the cylindrical core, no further locking will occur, thus diminishing the security of such a locking cylinder.

SUMMARY OF THE INVENTION

It is the object of the invention to provide a locking cylinder of the kind previously mentioned, which attains a high degree of security while being simple to manufacture.

This aim is achieved essentially with a locking cylinder wherein a locking channel lying in crossing or opposing position with respect to the housing pin bores is provided for the rotation-halting reception of the additional tumbler element, wherein a housing-adjacent tumbler pin spring-biased in the inward direction of the core can enter the core cavity (hollow) when the tumbler element is withdrawn across the separation interface, and wherein the spring force of the spring which loads the additional tumbler element is greater than that of the spring which loads the housing-adjacent tumbler pin.

Accordingly, there is provided a locking cylinder of the kind mentioned which is distinguished by a simple construction with increased security. The core-adjacent additional tumbler element works together with the housing-adjacent tumbler pin. The springs of the tumbler element and the tumbler pin are so dimensioned that the spring for the core-adjacent tumbler element is stronger than the spring loading the housing pin. In order to be able to rotate the cylindrical core after the key has been inserted, the core-adjacent tumbler element must be displaced by the wide-side profiling of the key shaft far enough that its outward end lies at the level of the rotational interface of the cylindrical core. Even small deviations in the displacement suffice to prevent completion of the locking process. One embodiment is distinguished in that the tumbler pin which can project into the core hollow is constructed as a housing-adjacent tumbler element provided in the locking channel. If a key is used that has a wide-side profile which does not correspond to the additional tumbler element and the housing-adjacent tumbler pin, locking occurs upon the successful insertion of the key. The housing-adjacent tumbler element or tumbler pin always follows the displacement of the core-adjacent tumbler element. If the separation interface passes beyond the rotational interface of the cylindrical core in the region of the core cavity, a locking does occur, in contrast to the previously mentioned GB 112 761. If the key lacks the wide-side profile, it simply cannot be inserted into the key channel. If the key shaft has a false wide-side profile, the tumbler elements will not be properly displaced, and thus the separation interface between the two tumbler elements will not be brought into alignment with the rotational interface of the cylindrical core. In order to achieve a reduced spatial requirement, the core-adjacent tumbler element has a reduced cross-section at about the middle, which is surrounded by the spring which is constructed as a compression spring. The latter extends in the cross-sectional region of the core-adjacent tumbler element. In order to achieve a non-rotational arrangement of the tumbler elements, the cavity is positioned non-diametrically and has a non-round section, providing a cavity in which the tumbler elements lie without being capable of rotation. By way of a small improvement, it is found to be advantageous for the contour of the mating faces of the tumbler elements to match the contour of the rotational interface. In order that the pressure spring loading the core-adjacent tumbler element have a core-adjacent abutment surface, a shoe positively guiding the reduction is provided on the core-adjacent cavity section, the shoe being such that it receives the pressure spring on one side while the other side provides an abutment surface for a shoulder which is adjacent to the control projection. This shoe thus has a double function. From the assembly point of view, it is an advantage for the core-adjacent tumbler element to be in two parts, such that one part provides the reduction and the other part provides an abutment surface. The two parts are assembled such that first the core-adjacent part of the shoe is put in place, following which the spring is mounted to the reduced portion, and then the portion providing the abutment surface is brought into connection. A clamping location can be provided between the two parts such that, after placing them together, the two parts function like a single part. A further advantage from a manufacturing aspect is the fact that the housing section which receives the cylindrical core is a hollow cylinder received in a cylindrical opening, the hollow cylinder being disposed with respect to the housing-adjacent cavity section in such a way that the bottom or base of the cavity section is constituted by the cylindrical wall. The key constituting the core-adjacent tumbler element is characterized in that the key profile of a side wall includes a longitudinal rib or groove. According to the construction of the side wall, the core-adjacent tumbler element must be configured so as to control the positioning of the tumbler elements in a prescribed manner. Also, the longitudinal rib is adjacent the small edge of the key. The problem-free insertion of the key in the key channel is made possible on the basis of the fact that the side wall section is made to extend obliquely at the leading end of the key, thus forming a guiding funnel. It is possible to manufacture the key also as a flat reversing key. Even if the key is tilted during its insertion into the key channel, it is nonetheless possible to insert the key because the key shaft in the region of its leading end forms roof-like opposed guiding slopes, which merge with the base of the longitudinal groove. In order to separate the guiding funnels from the remaining region of the key point, similar roof slopes are provided in the key point region located between the guiding slopes, the roof slopes defining a wider angle between them. The key side region adjacent to these roof slopes serves to guide tumbler pins, whose operative ends scan the wide side of the key. The security of the lock assembly is further increased in that the point region of the key shaft has a rib structure with a different cross-section than is found in the head region of the key shaft. The rib structure in the leading end region matches the cross-sectional structure of the key channel, such that the only key which can be completely inserted in the key channel is one which has the required cross-sectional profile. Copying or scanning of the key is made all the more difficult in that the point region of the key shaft has its greatest thickness at the edges. The result of this is that the longitudinal wall controlling the core-adjacent tumbler element is located below the wide side of the key, which leads to the advantage mentioned above.

Another embodiment is characterized in that the tumbler pin which is able to enter the core hollow can attain this position only after a partial rotation of the cylinder core, and is constituted by a housing pin which is correlated with the core pin. The important advantage of this construction is that now a completely normal housing pin fills a double function: On the one hand the housing pin works together with the correlated core pin. On the other hand, after a partial closing rotation of the cylindrical core, it scans the position of the added, core-adjacent tumbler element. If the latter is inserted too far into the core hollow due to the use of the wrong key, the housing pin can extend into the core hollow, thus stopping the closing rotation of the cylindrical core. Since this allows neither forward nor reverse rotation, the withdrawal of the key is blocked also. This means that the key is trapped. Key misuse is thus recognized. In order to facilitate the cooperation between the housing pin and the tumbler element, the axial position of the tumbler element is axially displaced with respect to the housing pin bore in such a way that the cross-sectional surface of the tumbler element intersects that of the housing-adjacent tumbler pin. Furthermore it should be emphasized that the cavity portion holding the tumbler element extends into a dipping cavity for the appropriate housing-adjacent tumbler pin. The outline of this space is arranged, with respect to the corresponding housing-adjacent tumbler pin, such that the latter, upon the use of an incorrect key that pushes the tumbler element too far into the core hollow, can project into the dipping hollow thus blocking the locking rotation of the cylindrical core. A sufficiently large overlapping between the dipping cavity and the tumbler element is attained by shaping the tumbler element in cross-section to resemble a trapezoid, such that the trapezoidal edge which lies opposite the base of the trapezoid provides the control projection. A hiding position for the tumbler element is attained by positioning it in the inner end region of the cylindrical core, whereby, when the key is withdrawn, it is protected from the adjacent core pin. The protected arrangement is further optimized by a protective pin which is provided on the control projection in the key insertion direction and scans a wide side groove of the key. If the key is not inserted, the protective pin securely prevents access to the control projection of the tumbler element. Also, the only key that can be inserted is one which has the corresponding wide-side groove. If such is not present, the key simply cannot be inserted. Finally, the key is advantageously of use in a master key installation, in which the master key provides a rib which defines, at the entry end, a control slope for the control projection, and following the latter a control recess such that the rib of the individual key has a blunt end in the insertion direction, furthermore has a constant cross-sectional contour. When an individual key is inserted into the locking cylinder of next higher rank, the individual key is unable, due to the lack of guiding slopes, to displace the extra tumblers, but instead abuts thereagainst and prevents further insertion of the key. Even when the guiding slope is subsequently and illegally provided on an individual key, the locking process will not take place, since while it is possible to insert the key, it is not possible to accomplish the required displacement of the core-adjacent tumbler element, so that after performing a locking rotation, further movement is stopped and the altered key becomes trapped.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENT

Figure 1:
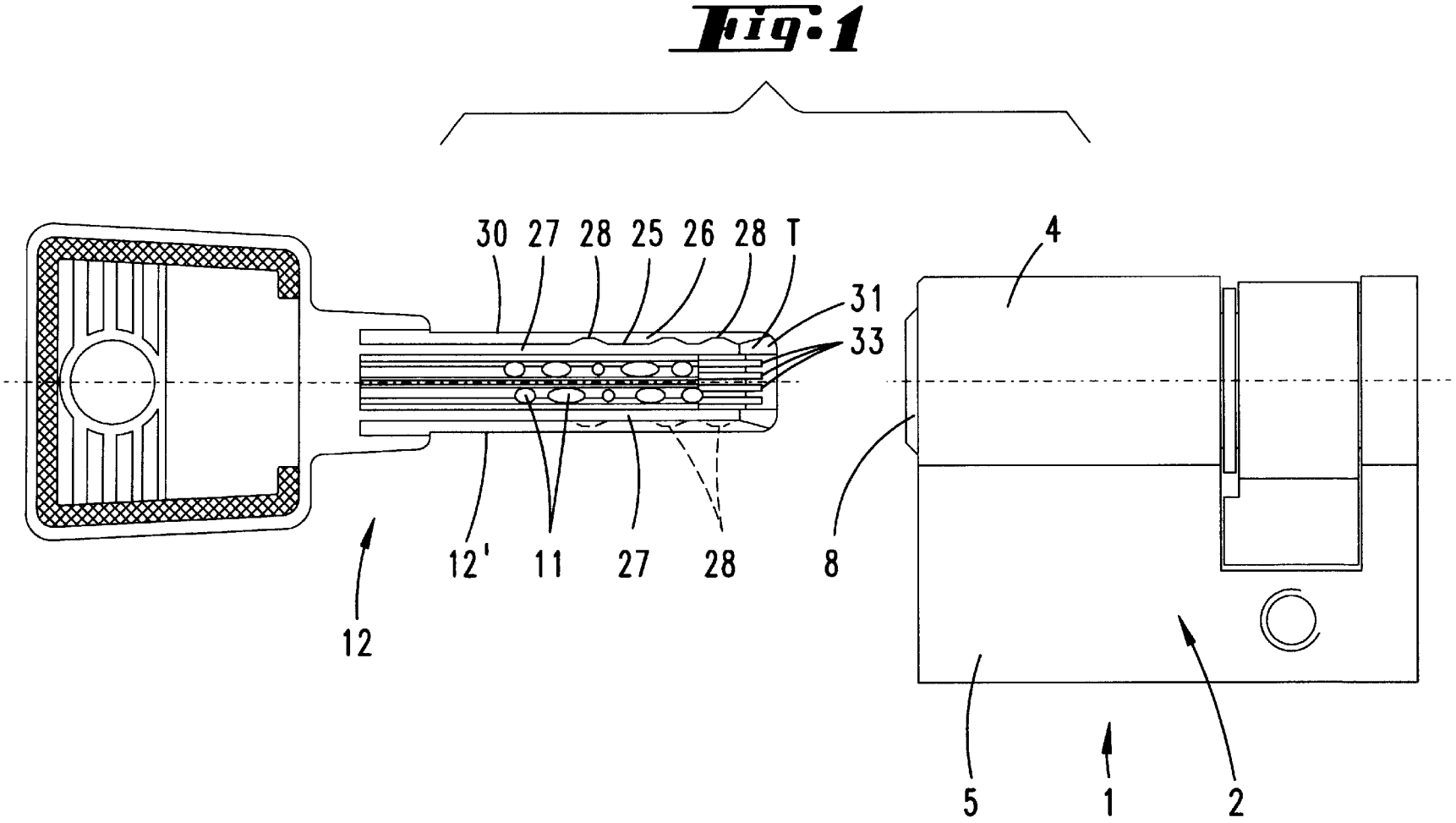
FIG. 1 is an elevation of a locking assembly in accordance with the invention, to an enlarged scale, the locking assembly being constituted by a key and a locking cylinder constructed as a profile semi-cylinder.
Figure 2:
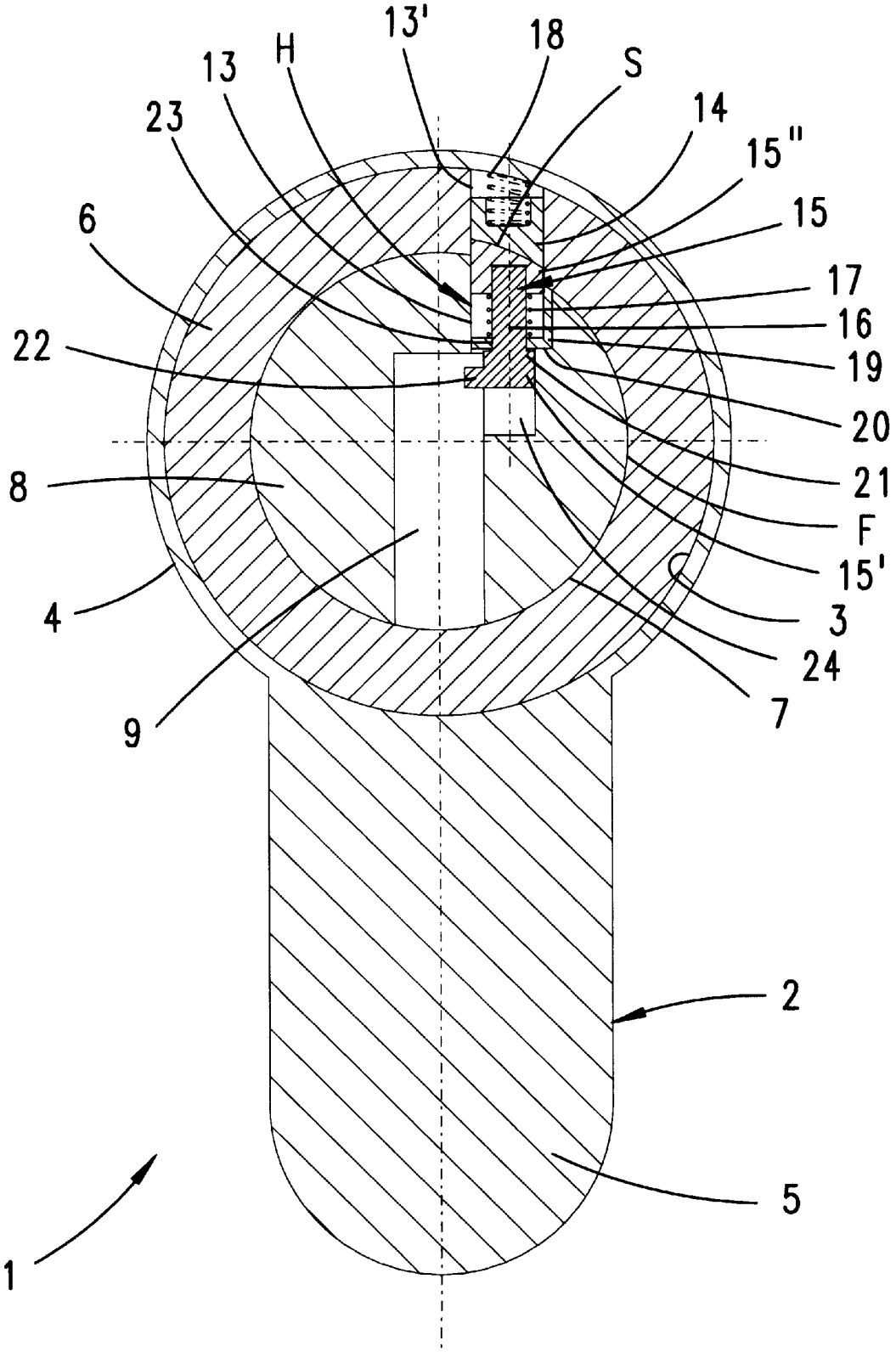
FIG. 2 is a cross-section through the locking cylinder in the region of a cavity which receives a tumbler element.
Figure 3:
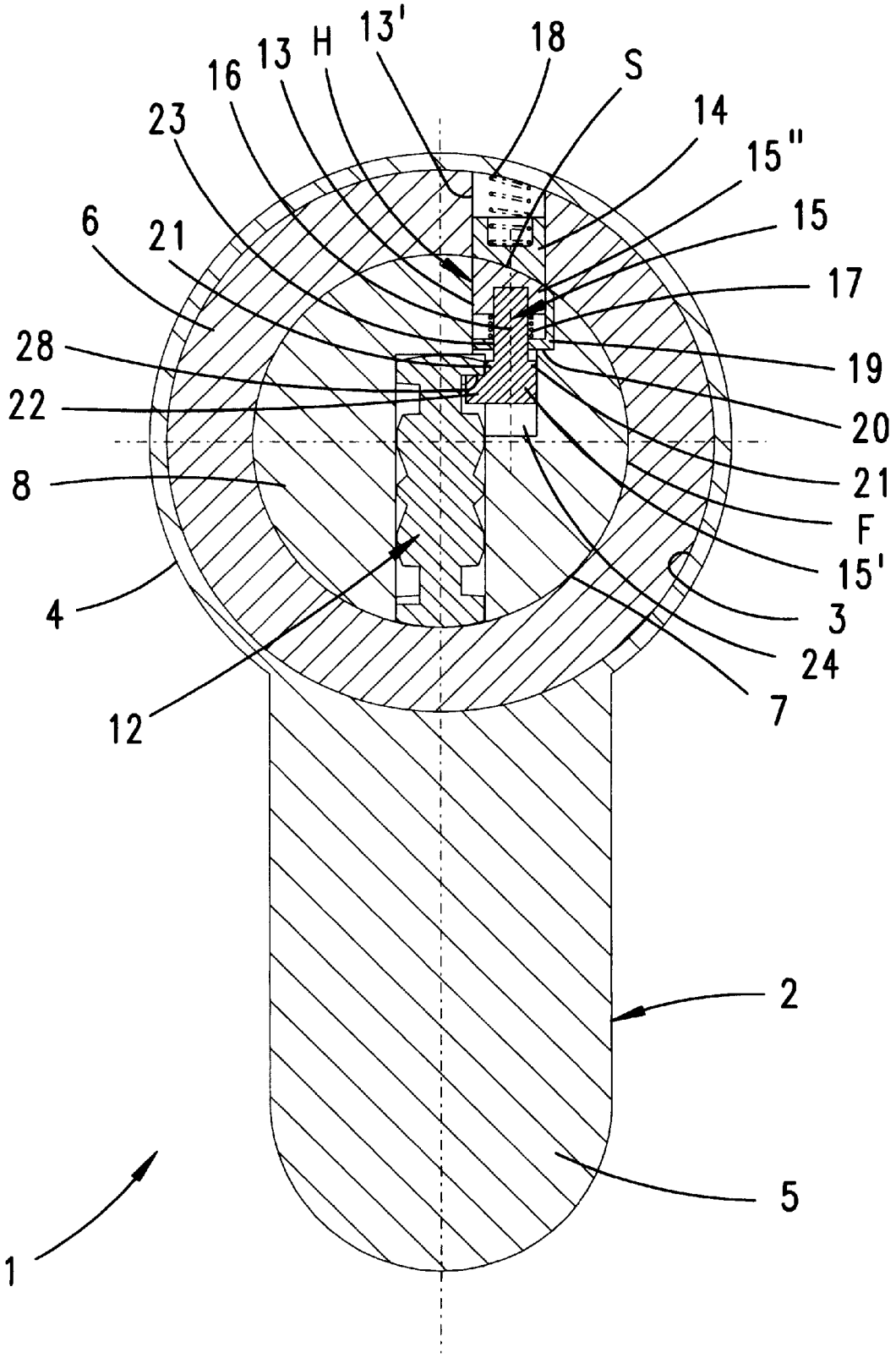
FIG. 3 is a view corresponding to FIG. 2, in which the appropriate key is inserted, with the tumbler elements arranged.

In accordance with the first embodiment, shown in FIGS. 1–10, the lock cylinder 1, constructed as a semi-cylinder in section, includes a cylinder housing 2 which comprises a cylindrical wall 4 of circular cross-section with a cylindrical opening 3, and a pin section 5 extending radially and integrally therefrom.

In the cylinder opening 3 is inserted a hollow cylinder appearing as a housing section 6, the hollow cylinder being secured by a set screw (not illustrated) extending from the pin section 5. The housing section 6 shaped as a hollow cylinder forms with its inner wall a core bore 7, in which a cylindrical core 8 is mounted. In the cylindrical core 8 there is cut a radial key channel 9 which is open toward one side of the rotational interface F of the cylindrical core 8, and aligned with the central longitudinal plane of the pin section 5. In known manner, the cylindrical core 8 receives paired tumbler pins 10 which are arranged in order by recesses 11 located on the wide side of the shaft of a key 12. The core-adjacent ends of the tumbler pins 10 that are biased in the direction of the key channel, project into the key channel 9 until limited by contact. Such tumbler pins 10 are already known, and therefore no further description is necessary.

Parallel to the longitudinal mid-plane of the key channel is provided a hollow (cavity) H crossing the rotational interface F of the cylindrical core 8, the hollow being made up of a core hollow 13 and a locking channel 13' in alignment therewith. The cylinder wall 4 provides the bottom of the locking channel 13'. The non-diametrically positioned hollow H is so located that it is in overlapping relation with the key channel 9 such that the core hollow 13 is open to the key channel 9.

The housing-adjacent locking channel 13' receives a housing tumbler biased in the inward direction of the core, which is constructed as a tumbler element 14 and co-operates with a core-adjacent tumbler element 15 biased in the outward direction of the housing. The tumbler connecting element 15 has a cross-sectional reduction 16 in the form of an off-set lug which is surrounded by a spring 17 in the form of a compression spring. The spring 18 on the housing-adjacent tumbler element 14 is also provided as a compression spring and is anchored in the cylindrical wall 4. The sizings of the springs 17, 18 are selected such that the spring force of the core-adjacent spring 17 is larger than that of the housing-adjacent spring 18. This ensures that the housing-adjacent tumbler element 14 always follows the movement of the core-adjacent tumbler element 15. Due to the non-diametrical positions of the tumbler elements 14, 15, the hollow H has a non-round cross-section, in which hollow H the tumbler elements 14, 15, non-rotatably lie. Thereby, the forward face contour S, or the separation interface between both tumbler elements 14, 15, conforms to the rotational interface contour.

The core hollow 13 receives a shoe 19 that positively guides the reduced portion 16, on one side of which the compression spring 17 bears. The other side of the shoe 19 however constitutes an abutment surface 20 for a shoulder 21 of the core-adjacent tumbler element 15, such that the latter always assumes a defined end position when no key is present.

The core-adjacent tumbler element 15 consists of two parts. The one part 15' is provided by the reduced portion 16, and the other part 15" is provided by the outer surface. Connected to the shoulder 21 there is formed on the part 15' a control projection 22 extending into the key channel 9.

The assembly of the core-adjacent, split connection element 15 takes place as follows. First the portion 15' with its lug-like reduced portion 16 is inserted into a bore 23 of the shoe 19. Next the compression spring 17 and finally the portion 15" are pressed onto the end section of the reduced portion 16, so that both parts 15', 15" function as a single piece. Then the core-adjacent tumbler element 15 along with the shoe is inserted into the core hollow 13. The parts are dimensioned so as to make possible a displacement of the core-adjacent part 15' in the inward direction of the core. The corresponding space is marked with the number 24. It would be possible, in order to allow an integral tumbler element 15, to place the compression spring 18 in the space 24, this not being illustrated.

The key profile co-operating with the control projection 22 is characterized on one side wall 25 by a longitudinal rib 26 or groove 27. To this end, side wall 25 is provided with at least one control recess 28 which, seen in the longitudinal direction of the key, takes the form of adjacent roof-like control slopes 29. In the example embodiment, three such control recesses 28 are provided in a row, so that the lock cylinder 1 has a corresponding number of pair-arranged connecting elements 14, 15.

The longitudinal rib 26 is adjacent the narrow edge of the key. In the region of the key point, the side wall 25 is formed into a side-wall section 25' which defines part of a guide-funnel T running angularly toward the point of the key. The diametrically opposed longitudinal rib 26, seen in cross-section, is likewise correspondingly formed, so that the key 12 can function as a flat, bi-directional key.

Figure 8:
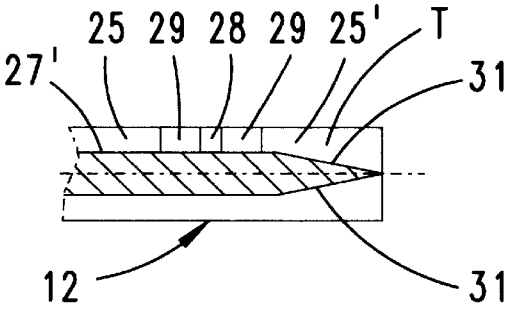
FIG. 8 is the section taken along the line VIII—VIII in FIG. 5.
Figure 9:
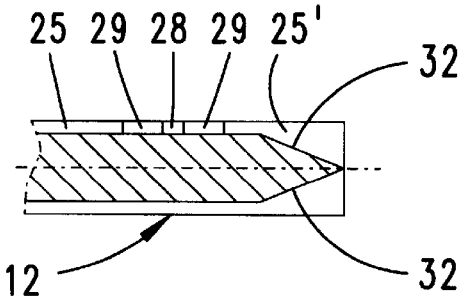
FIG. 9 is the section taken along the line IX—IX in FIG. 5.
Figure 10:
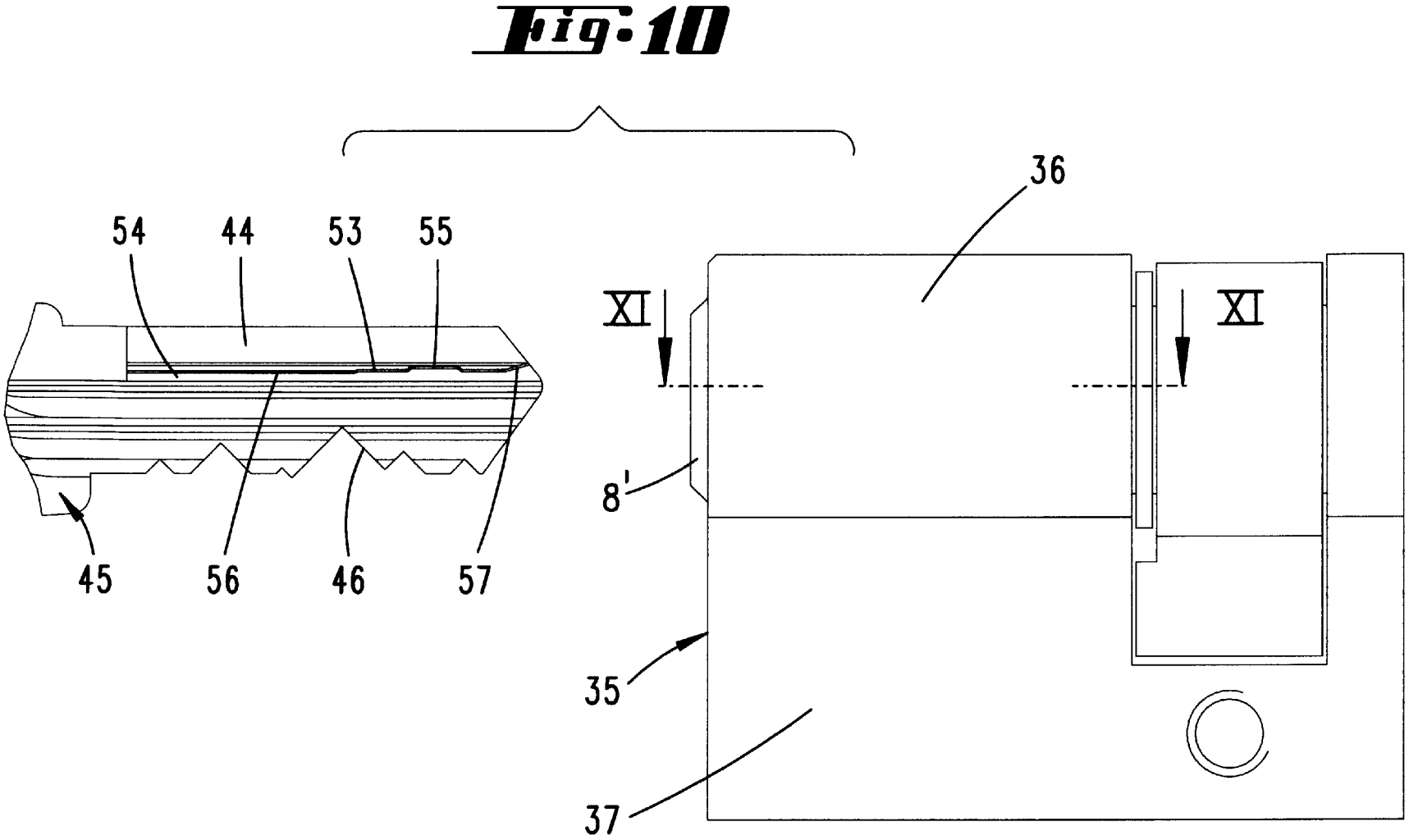
FIG. 10 is an elevational view of a locking apparatus comparable to that in FIG. 1, but relating to the second embodiment.

In the region of the point of the key are provided sloping portions 31 in a roof-like arrangement at an acute angle, which merge with the base 27' of the longitudinal grooves (see in particular FIG. 8). Between the sloping portions 31 in the region of the point of the key are provided roof-slopes 32, which form a larger angle by comparison with the angle previously mentioned.

Figure 5:
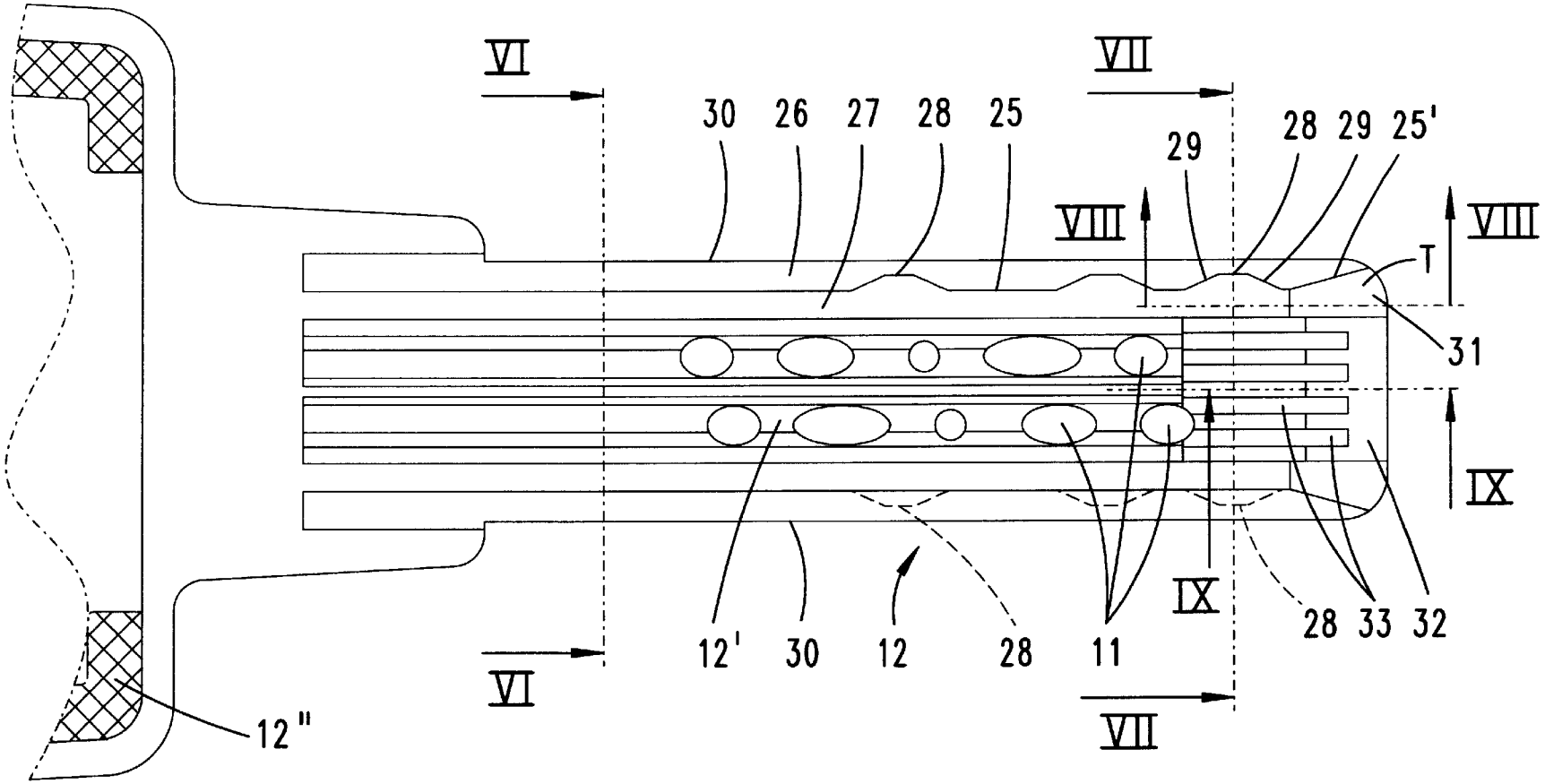
FIG. 5 is an elevation of an appropriate key, drawn to a much enlarged scale.
Figure 6:
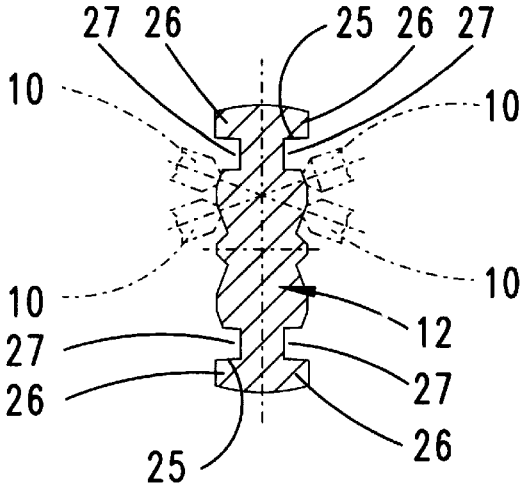
FIG. 6 is a cross-section through the a key shaft taken along the line VI—VI in FIG. 5.
Figure 7:
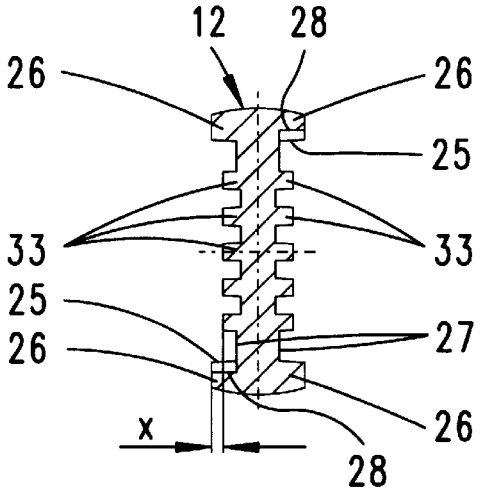
FIG. 7 is the section taken along the line VII—VII in FIG. 5.

As particularly illustrated in FIGS. 5, 6 and 7, the key shaft 12' connected to the key grip 12" has, in the region of the point of the key, a rib structure with a different cross-section than is found in the region of the key shaft 12' which is adjacent to the grip. Between two longitudinal ribs 26 provided at the extremities of the wide side of the key there are ribs 33 extending in the longitudinal direction of the key shaft, the ribs 33 being set inward by an amount x with respect to the longitudinal ribs 26. Because of this, it is more difficult to scan or copy the key. The ribs 33 terminate however in the region before the first recess 11 of the key shaft 12' or are tangential thereto. Corresponding to this rib structure, the key channel 9 of the cylindrical core 8 also has, in the extremity region, a corresponding sectional profile. The sectional profile created by the ribs 33 merges with the sectional profile in the region of the key grip in such a way that the ordering of the tumbler pins 10 is not impaired.

The operation is as follows.

A locking rotation of cylindrical core 8 requires the insertion of the correct key 12 in the key channel 9. During the insertion operation, the tumbler pins 10 and also the tumbler elements 14 and 15 are arranged so as to make possible the rotation of the cylindrical core. From the standpoint of the tumbler elements 14 and 15, it appears as though, from the respective side wall 25 with the control recesses 28 located therein, the control projections 22 are shifted in a corresponding way. In accordance with FIGS. 2 and 3, the core-adjacent tumbler element 15 is pulled inwardly with respect to the core. The spring-loaded tumbler element 14 follows this shift. In the completely inserted condition, the outer contour S between the two tumbler elements 14 and 15 is aligned with that of the rotational interface F of the cylindrical core 8, so that the locking rotation of the cylindrical core can be accomplished.

During the insertion movement of the key shaft 12' in the key channel 9, the roof slopes 32 displace the tumbler pins 10 which they contact, while the sloping portions 31, even when the key shaft 12' is slightly angulated, make it possible for the control projections 22 to be lodged in the longitudinal groove 27. The insertion funnel T also functions in this manner.

Figure 4:
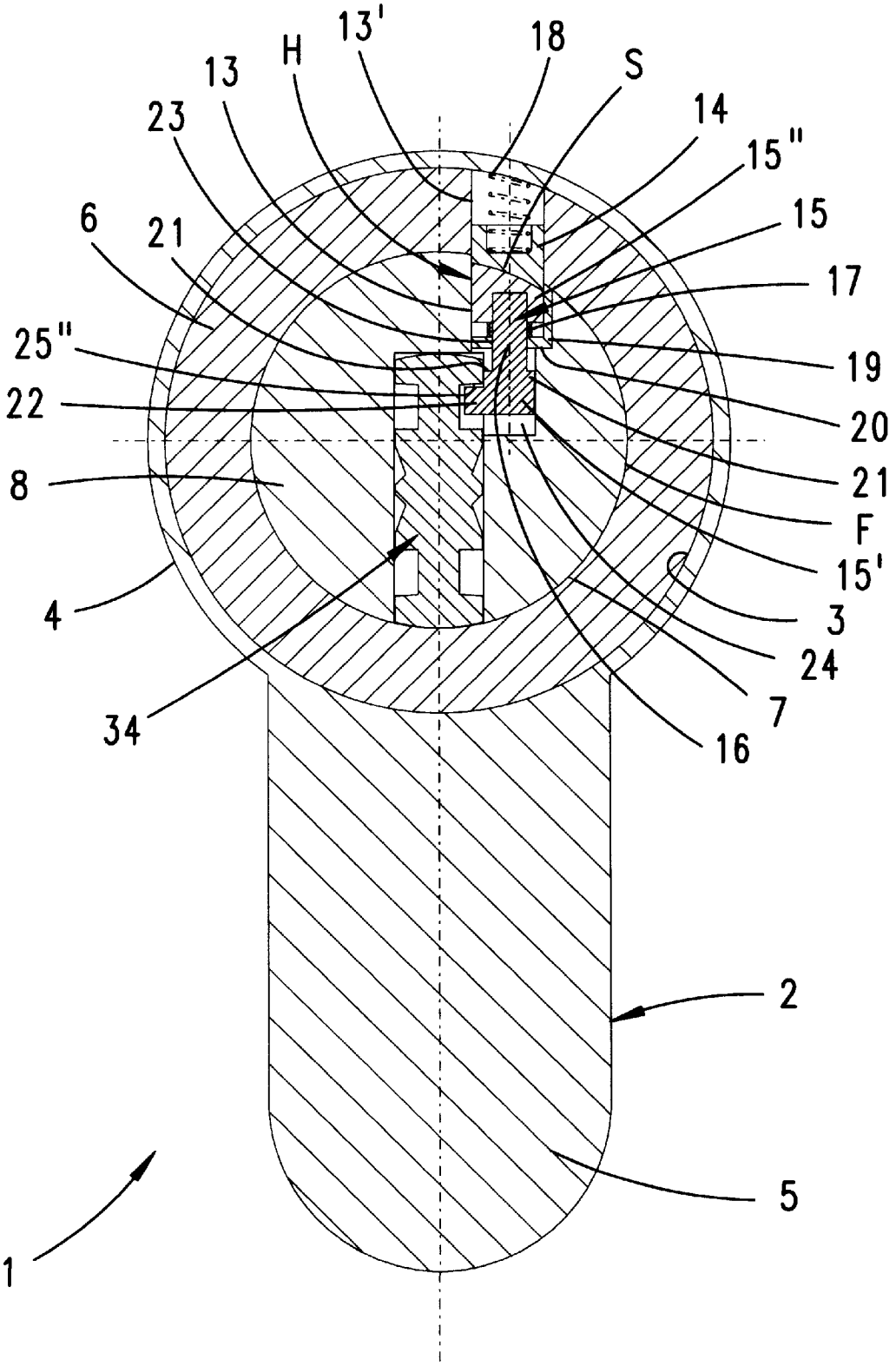
FIG. 4 is likewise a section corresponding to FIG. 2, in which the wrong key is inserted.

FIG. 4 illustrates an incorrect key 34, of which the side wall 25" is so configured that it displaces the core-adjacent tumbler element 15 so far that the facing contour S of the tumbler elements 14, 15 has shifted past the rotational interface F of the cylindrical core, and is located inside the cylindrical core 8. This prevents rotation of the cylindrical core 8 due to the housing-adjacent tumbler element 14, such that even with correctly configured tumbler pins 10, the cylindrical core 8 is blocked against rotational movement.

The second embodiment, illustrated in FIGS. 10 through 18, is likewise a locking cylinder 35 configured as a semi-cylinder in section. The cylindrical section 36 rotatably receives, in the core bore 7, a cylindrical core 8' whereas the pin section 37 provides housing pin bores 38. In the latter bores are provided housing tumbler pins 40 acted upon by compression springs 39. These cooperate with core pins 42 located in core pin bores 41. In the plane of the cylindrical core 8' which passes through the core pins 42, there extends a key channel 43 for receiving the correspondingly profiled shaft 44 of a key 45. The edge of the key is provided with notches 46, which displace the core pins 42 in such a way that the interface between the core pins 42 and the housing pin 40 is aligned with the rotary interface F of the cylindrical core 8'.

Figure 11:
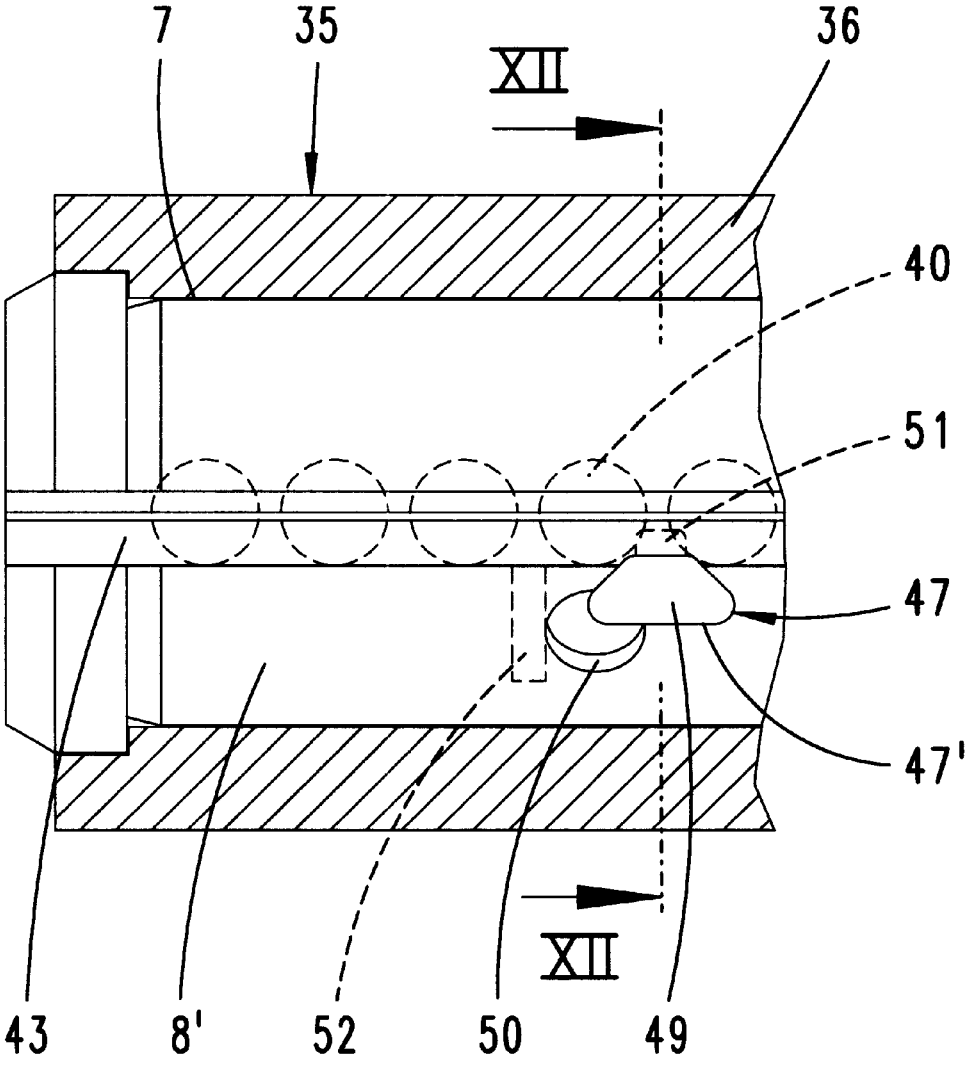
FIG. 11 is the section taken along the line XI—XI in FIG. 10.
Figure 12:
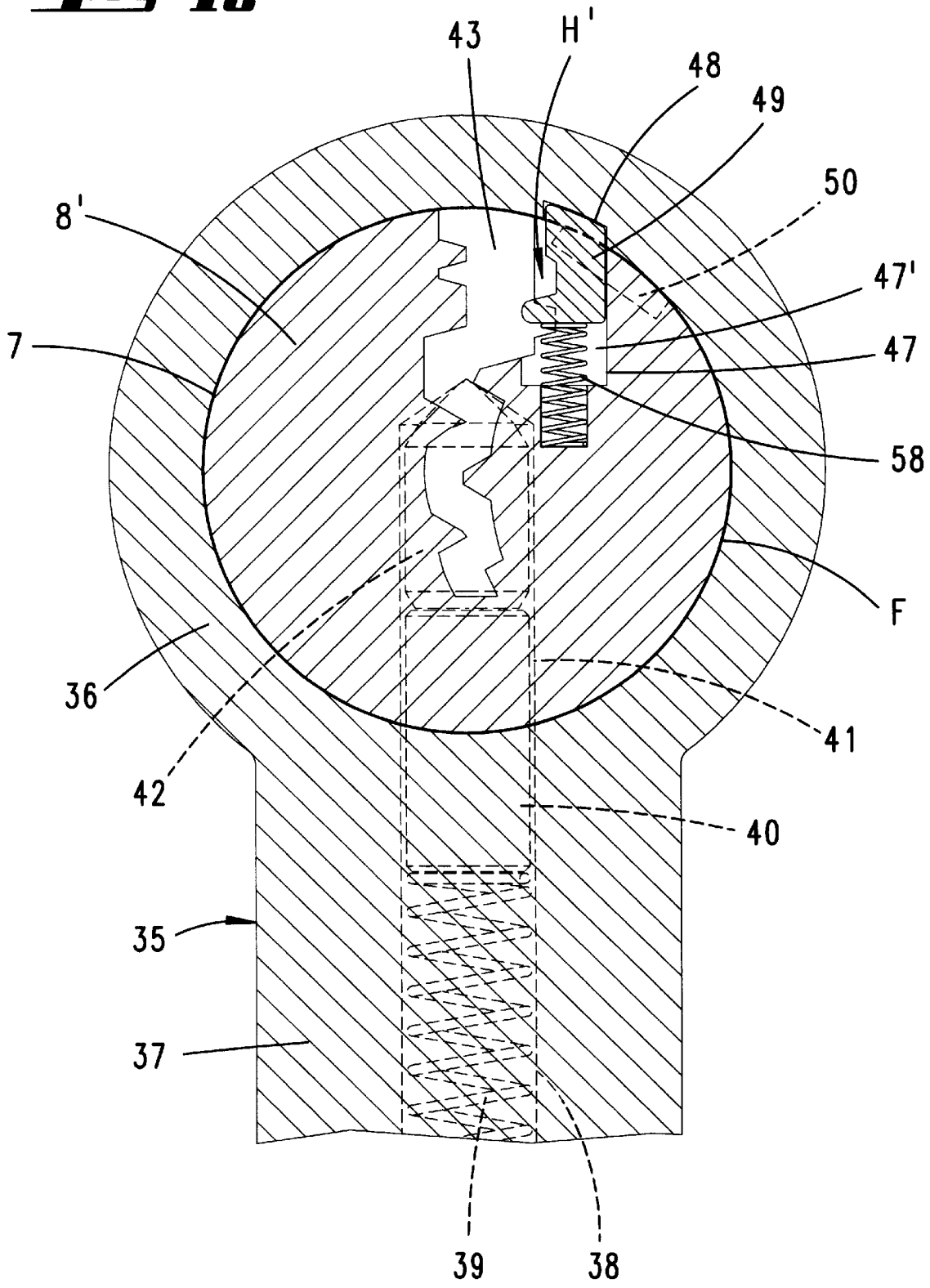
FIG. 12 is the section taken along the line XII—XII in FIG. 11 drawn to a larger scale.
Figure 14:
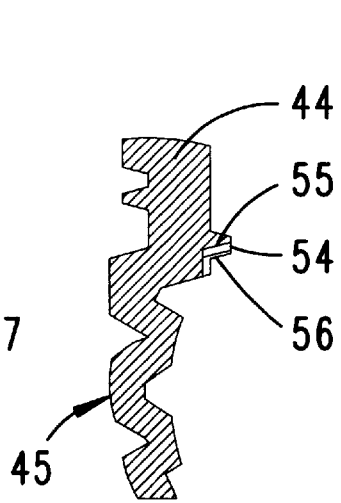
FIG. 14 is the section taken along the line XIV—XIV in FIG. 13.
Figure 13:
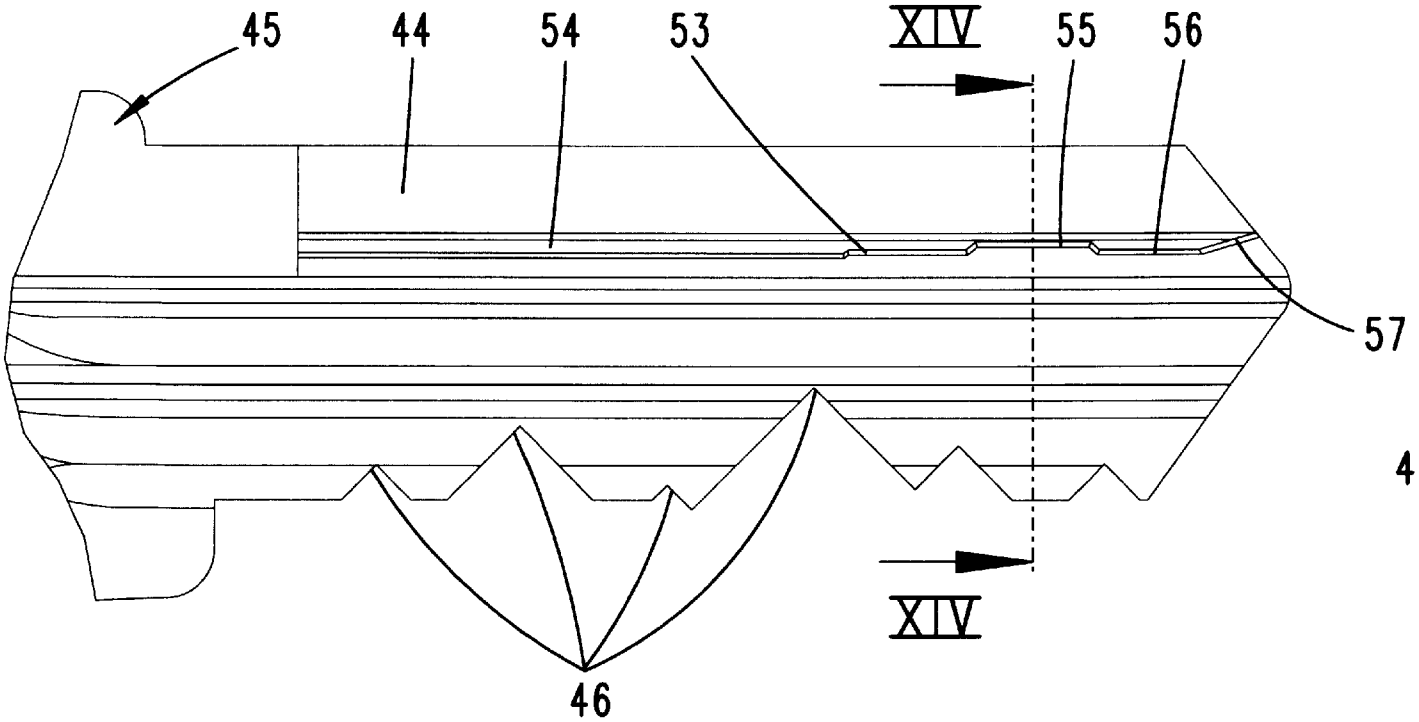
FIG. 13 is an enlarged elevational view of the appropriate key shaft.
Figure 15:
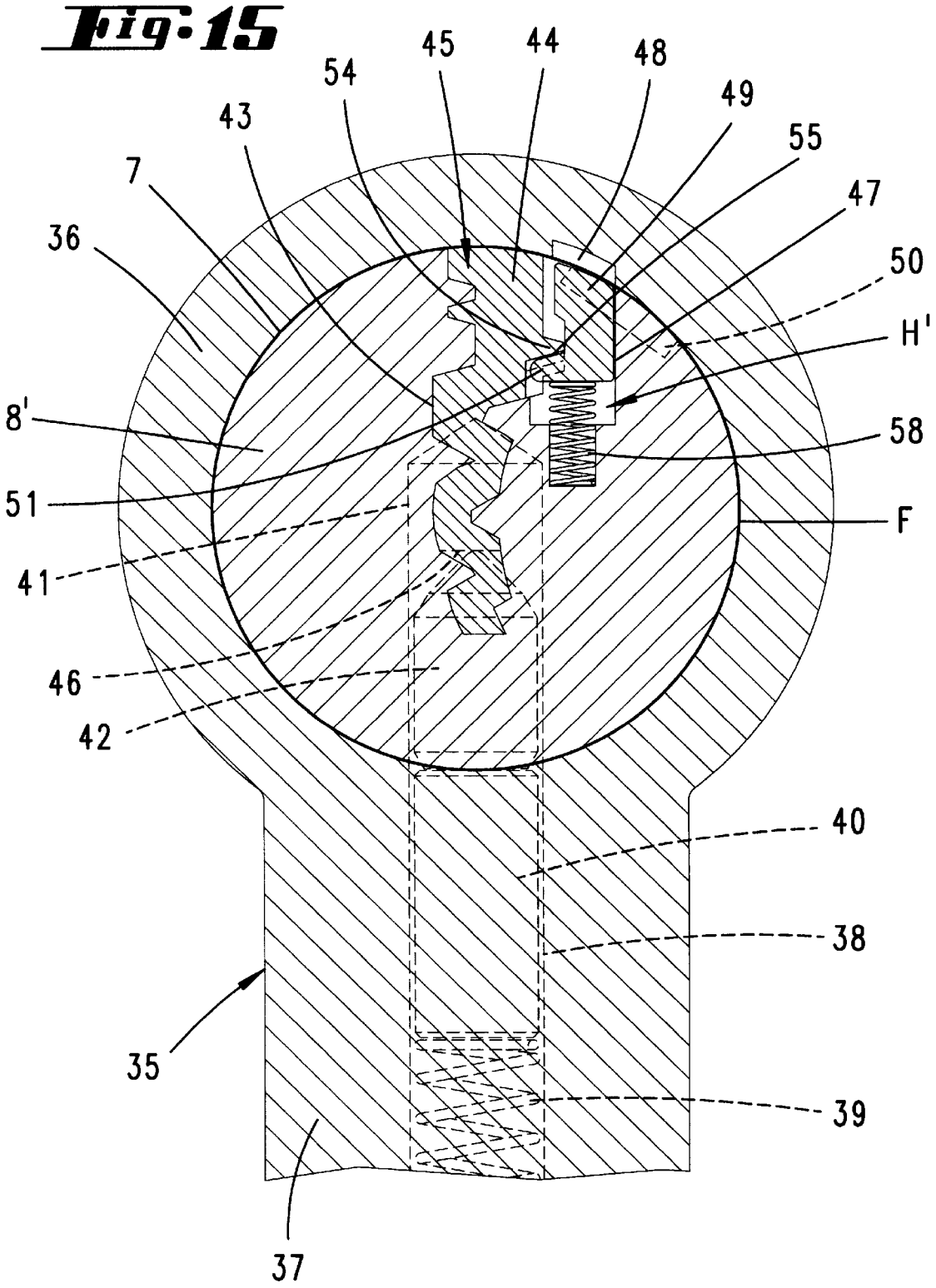
FIG. 15 is a sectional view comparable to that of FIG. 12, but differing in that the appropriate key inserted while the core-adjacent tumbler element is withdrawn.

A cavity H' extends parallel with the key channel 43 and crosses the rotational interface F. The cavity H' consists of the core cavity (hollow) 47 which opens into the key channel 43, and the locking cavity (channel) 48 on the housing side. More specifically, the core cavity (hollow) 47 has a cavity portion 47' which guides a tumbler element 49, the cavity portion 47' merging with a dipping space 50. The latter extends in the rotational plane of one of the adjacent tumbler pins 40 (compare FIG. 11 in particular). The tumbler element 49, urged by a spring 58 in the direction radially outwardly of the core, is somewhat trapezoidal in cross-section. The side of the trapezoid lying opposite the base thereof forms, in the key channel 43, an inwardly extending control projection 51. As FIG. 11 shows, the control projection 51 is in the space between two adjacent tumbler pins, and thus also the tumbler element 49. It can be further seen from FIG. 11 that the axial position of the tumbler element 49 lies axially offset with respect to the housing pin bores 38, such that the cross-section plane of the tumbler element 49 and of the housing-adjacent tumbler pin 40 intersect one another. FIG. 11 illustrates that the tumbler element 49 is located at the inner end region of the cylindrical core 8'.

Further, in the key-insertion direction, the control projection 51 is provided with a guard (protection) pin 52. The latter registers in a wide-side groove 53 of a longitudinal rib 54 located on the key shaft 44. If the wide-side groove 53 is not provided on the key shaft, the latter cannot be inserted. This means that both the guard pin 52 and the wide-side groove 53 must be correspondingly positioned.

Seen in the direction of the point of the key, there is provided on the wide-side groove 53 a control indentation 55 in the longitudinal rib 54, the indentation exhibiting sloping steps in the side wall of the longitudinal rib 54. In the region of the point of the key, the side wall 56 has a guiding slope 57.

The locking cylinder 35 in accordance with the second embodiment functions as follows:

When no key 45 is present in the key channel 43, the cylinder core 8' is locked against rotation both by the housing pins 40 and by the tumbler element 49, which goes beyond the rotational interface F and lodges in the locking cavity 48.

Rotation of the cylindrical core 8' requires the insertion of the correct key 45, which in the example embodiment can be a master key. Because of the lock notches 46, the housing pins 40 and the core pins 42 are so positioned that the separation space between them becomes aligned with the rotational interface F of the cylindrical core 8'. Also, as the key is inserted, the tumbler element 49 is withdrawn due to the guide slope 57 and the control projection 51. When the key 45 is in the inserted position, the control projection 51 and the control indentation 55 interact so that the outward face of the tumbler element 49, which conforms to a cylindrical shape, lies in alignment with the rotational interface F. The cylinder core 8' can then be rotated using the key 45. Since the spring 58 loading the tumbler element 49 in the direction outwardly of the core is stronger than the compression spring 39 which loads the housing pin 40, it is not possible during the closing rotation of the cylindrical core 8', for the housing pin 40 to enter the dipping space 50 of the cavity section 47' of the core cavity 47.

Figure 16:
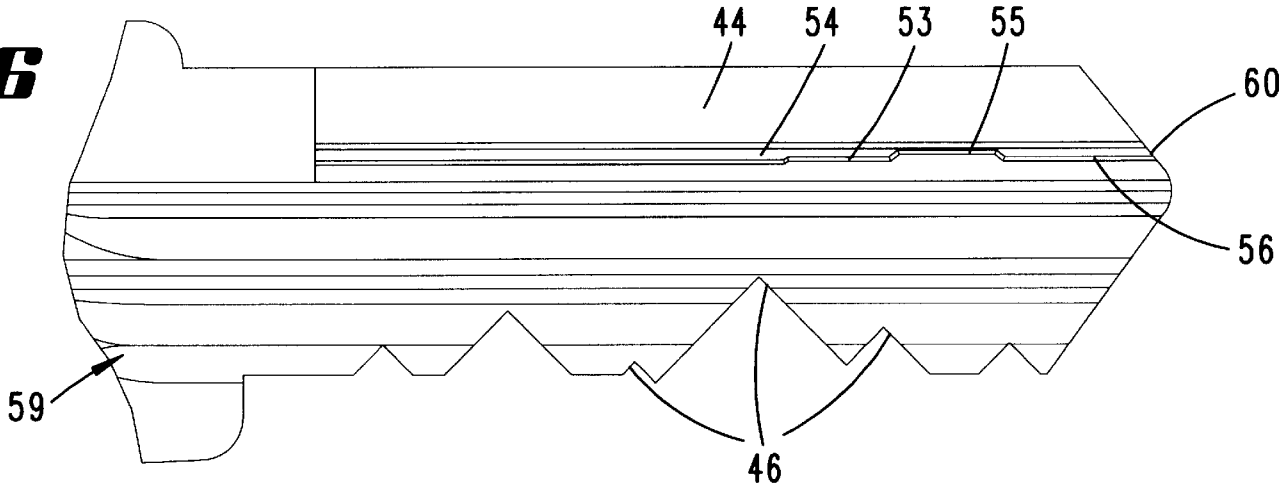
FIG. 16 is an elevational view of the key shaft of an inappropriate key, in which the guiding slope at the insertion end of the rib is lacking.

FIG. 16 illustrates a false or incorrect key which is largely identical with the key 45. However, this false key 59 lacks the guiding slope 57 on the longitudinal rib 54. This means that the longitudinal rib 54 has a blunt end in the insertion direction. When insertion of this key 59 is attempted, the blunt end 60 of the longitudinal rib 54 abuts against the control projection 51 and blocks further insertion of the key 59.

Figure 17:
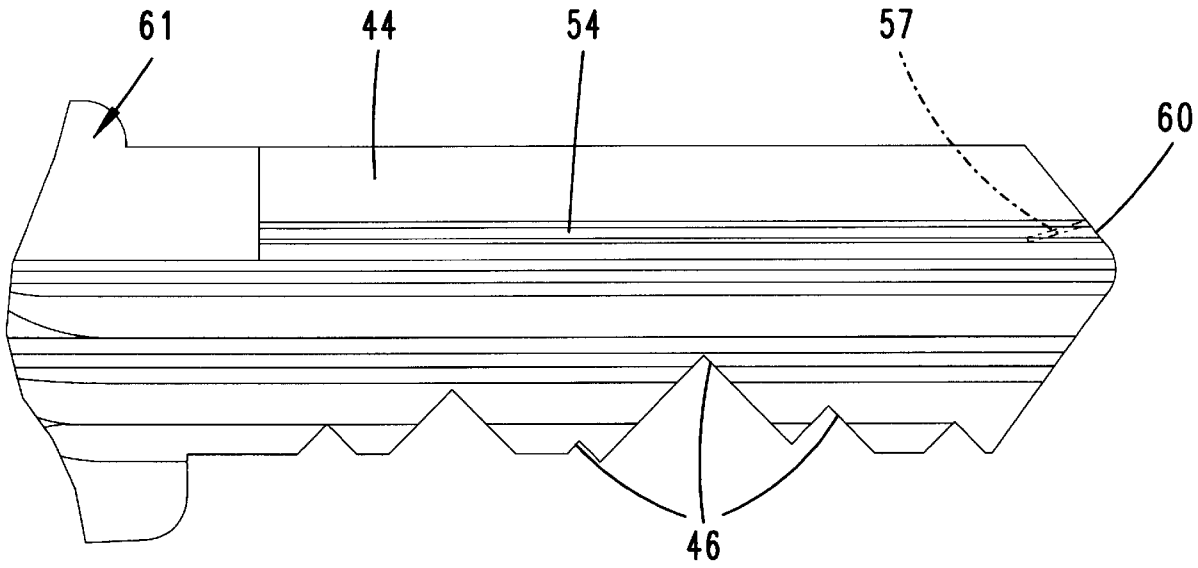
FIG. 17 is an elevational view of the key shaft of a key constructed as an individual key.
Figure 18:
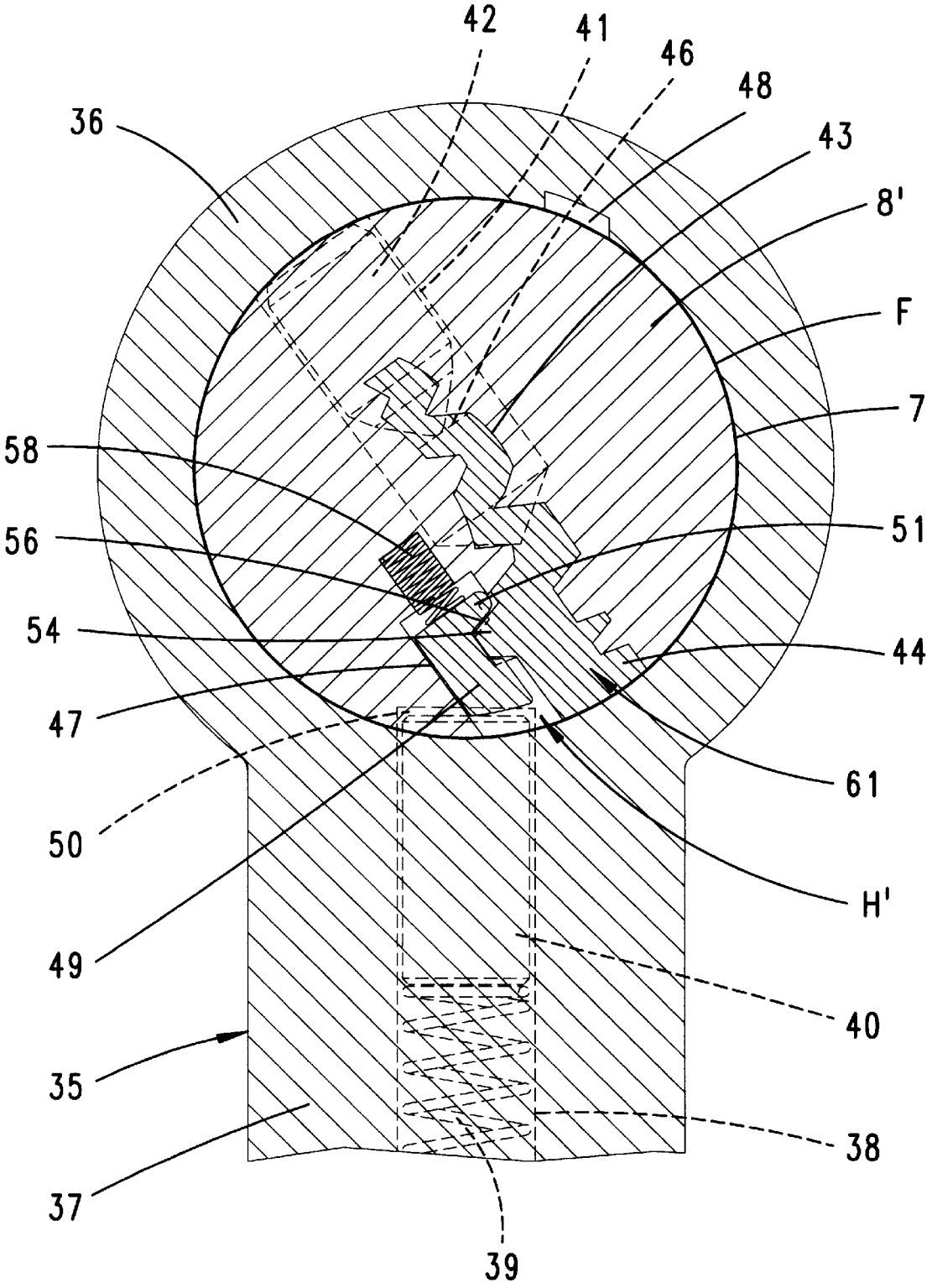
FIG. 18 is a cross-section similar to FIG. 12, in which the key of FIG. 17 is inserted in the key channel, following a partial rotation of the cylindrical core as far as the locking position.

FIG. 17 illustrates a key 61 of which the longitudinal rib 54 likewise has a blunt end in the insertion direction and moreover has a constant cross-sectional contour. This key 61 might serve as an individual key in a master key installation. Therefore it would not activate the locking cylinders of the next rank above, since these include the retention element 49. By contrast, it can be inserted into the locking cylinders of lower order, and succeed in positioning the core pins and housing pins. If one were to provide on this key 61 a guiding slope 57, as illustrated in FIG. 17 with broken lines, then the key 61 could be fully inserted into the key channel. It would then bring the core pins 42 and the housing pins 40 into the required configuration. However, because of the lacking control recess 55, the tumbler element 49 would be withdrawn so far into the cavity section 47', that the locking cavity 48 would be empty. After a locking rotation of about 180°, the locking cavity 48 would reach the level of the corresponding housing pin 40, so that the compression spring 39 which loads the housing pin 40 would push the latter into the locking cavity 48, and thus block any further rotational movement of the cylindrical core 8'. In this way, the key 61 is trapped, such that the locking procedure cannot be carried out, and a misuse is immediately recognized.

I claim:

1. A locking cylinder comprising a cylinder housing, a cylindrical core rotatably disposed in a core bore inside the cylinder housing, said cylindrical core contains a key channel, core pins provided in the cylindrical core and housing pins moveably guided in housing pin bores, the housing pins being resiliently biased by springs in a direction of the core pins, and at least one core-adjacent, tumbler element disposed displaceably, within a cavity which crosses a rotational interface of the cylindrical core, by a wide-side profile of a key insertable into the key channel, a first spring spring-loading the tumbler element in the outward direction of the core, said tumbler element having a control projection projecting sidewards into the key channel, said cavity comprises a core hollow and a locking channel, said locking channel is positioned across or opposite the housing pin bores for rotation-blocking reception of the tumbler element, a housing-adjacent tumbler pin spring-biased in a core-inward direction projectable into the core hollow when the tumbler element is withdrawn across the rotational interface, and a second spring spring-biasing the housing-adjacent tumbler pin in said core-inward direction, and wherein the spring power of the first spring which loads the tumbler element is greater than that of the second spring which biases the housing-adjacent tumbler pin.

2. A locking cylinder according to claim 1, wherein the tumbler pin constitutes a tumbler element movably disposed in the locking channel.

3. A locking cylinder according to claim 1, wherein said core-adjacent tumbler element has an approximately central cross-section reduction, and said cross-section reduction is surrounded by the first spring formed as a compression spring.

4. A locking cylinder according to claim 2, wherein the cavity is positioned non-diametrically with respect to said cylindrical core and has a non-round cross-section, and the tumbler elements are non-rotatably disposed in said cavity.

5. A locking cylinder according to claim 2, wherein a face contour of the tumbler elements conforms to the contour of the rotational interface.

6. A locking cylinder according to claim 3, further comprising a shoe provided in the core hollow and snuggly guiding the reduction, the first spring bearing against one side of the shoe, whereas the other side of said shoe provides an abutment surface for a shoulder of said core-adjacent tumbler element, said shoulder being adjacent to said control projection.

7. A locking cylinder according to claim 3, wherein the core-adjacent tumbler element comprises two parts, one of said parts has the reduction and the other of said parts has a face contour corresponding to the contour of the rotational interface.

8. A locking cylinder according to claim 1, further comprising a housing section having said core bore receiving the cylindrical core, said housing section is a hollow cylinder mounted in a cylindrical opening in a cylinder wall of said cylinder housing, the locking channel being provided in the hollow cylinder, a base of the locking channel being formed by the cylinder wall of the cylinder housing.

9. A locking apparatus comprising a locking cylinder according to claim 1, and an associated said key, wherein a shaft of the key has a side wall with a shaft profile formed with a longitudinal rib adapted to engage said control projection.

10. The locking apparatus according to claim 9, wherein the longitudinal rib is adjacent a narrow edge of the key.

11. The locking apparatus according to claim 9, wherein said key has a side-wall portion forming part of a guide-funnel and extending inclined adjacent a point of the key.

12. The locking apparatus according to claim 9, wherein the key is formed as a flat reversible key.

13. A locking cylinder as claimed in claim 1, wherein face ends of the core pins scan a wide side of the key.

14. The locking apparatus according to claim 9, wherein a point region of the key shaft has a different rib structure cross-section than that of a region of the key shaft adjacent a grip portion of the key.

15. The locking apparatus according to claim 9, wherein a greatest thickness of a point region of the key shaft is located at an edge of the key.

16. The locking cylinder according to claim 1, wherein the tumbler pin adapted to project into the core hollow must first, by a partial rotation of the cylindrical core be brought into a projecting position, the tumbler pin constituting one of said housing pins associated with one of the core pins.

17. The locking cylinder according to claim 1, wherein an axial position of the tumbler element is axially displaced with respect to one of the housing pin bores corresponding to the housing-adjacent tumbler pin such that the cross-section surface of the tumbler element intersects that of the housing-adjacent tumbler pin.

18. The locking cylinder according to claim 1, wherein a cavity portion of the core hollow contains the tumbler element, and said cavity portion is continuous in a mouth region thereof with a dipping space for the housing-adjacent tumbler pin.

19. The locking cylinder according to claim 1, wherein the tumbler element has a cross-section which is substantially trapezoidal, such that a trapezoidal side opposite a trapezoidal base forms the control projection.

20. The locking cylinder according to claim 1, wherein the tumbler element is located in an inner end region of the cylindrical core.

21. The locking cylinder according to claim 1, wherein said key has a wide side formed with a recess, a protection pin arranged on the control projection in a key-insertion direction, adapted to scan the recess of the key.

22. A locking apparatus comprising a locking cylinder according to claim 1, and an associated said key, wherein a shaft of the key has a side wall with a shaft profile formed with a longitudinal groove adapted to engage said control projection.

23. The locking apparatus according to claim 22, wherein said key forms roof-shaped, mutually opposed ramp slopes at a point of the key, and wherein said slopes merge with the longitudinal groove.

24. The locking apparatus according to claim 23, wherein a key-point region of the key between the ramp slopes has roof slopes which are set at a larger angle to each other than that of said ramp slopes.

* * * * *